US009797161B2

(12) United States Patent
Kaukinen

(10) Patent No.: US 9,797,161 B2
(45) Date of Patent: Oct. 24, 2017

(54) SECURITY DOOR LOCK

(71) Applicant: Oviku Oy, Helsinki (FI)

(72) Inventor: Raimo Kaukinen, Villähde (FI)

(73) Assignee: Oviku Oy, Helsinki (FI)

( * ) Notice: Subject to any disclaimer, the term of this patent is extended or adjusted under 35 U.S.C. 154(b) by 17 days.

(21) Appl. No.: 14/980,822

(22) Filed: Dec. 28, 2015

(65) Prior Publication Data

US 2017/0183892 A1 Jun. 29, 2017

(51) Int. Cl.
*E05B 13/00* (2006.01)
*E05B 15/16* (2006.01)
*E05B 17/20* (2006.01)

(52) U.S. Cl.
CPC ..... *E05B 13/004* (2013.01); *E05B 15/1614* (2013.01); *E05B 17/2003* (2013.01)

(58) Field of Classification Search
CPC ..... E05B 13/00; E05B 13/10; E05B 13/004; E05B 63/00; E05B 15/1614; E05B 17/2003
USPC ..... 70/416; 292/346, 358, 359
See application file for complete search history.

(56) References Cited

U.S. PATENT DOCUMENTS 2,651,193 A * 9/1953 Welch ..... E05B 13/004 292/359
2,912,846 A * 11/1959 Schweitzer ..... E05B 57/00 292/224
6,164,099 A * 12/2000 Sh ..... E05B 13/004 292/336.3
7,530,245 B2 * 5/2009 Fan ..... E05B 63/18 292/359
2013/0145800 A1 * 6/2013 Liu ..... E05B 55/005 70/91
2015/0345175 A1 * 12/2015 Ali ..... E05C 1/163 292/358

FOREIGN PATENT DOCUMENTS

GB 1145863 A * 3/1969 ..... E05B 13/004
SE GB 1279989 A * 6/1972 ..... E05B 13/004
WO 2014/202832 A1 12/2014

* cited by examiner

*Primary Examiner* — Suzanne Barrett
(74) *Attorney, Agent, or Firm* — Ladas & Parry LLP

(57) ABSTRACT

A security door lock for security back locking of a door lock. The door lock enables back locking of the door lock from inside in such a way that the lock cannot be opened with a key or a picklock. The lock includes a lock body, a lock bolt inside the lock body, a lock bolt shifter inside the lock body, a lock bolt shifting lever protruding from the lock bolt shifter, a slot in the lock body for receiving the lock bolt shifting lever which is turnable between its inclined end positions in the slot when the lock bolt shifter is rotated, a twist knob inside the door for rotating the lock bolt shifter, a key cylinder outside the door, and an opening spindle present between the twist knob and the key cylinder. The opening spindle is in engagement with the lock bolt shifter for shifting the lock bolt by tuning the key or the twist knob. A security latch is movable from a security locking release position to a security locking position in which the security latch covers the slot in the lock body thereby preventing turning of the lock bolt shifting lever between its inclined end positions and locking the lock bolt shifter in a non-rotatable manner against turning effected with the key or the twist knob.

7 Claims, 2 Drawing Sheets

Section A-A

SECURITY DOOR LOCK

The invention relates to a security door lock for security back locking of a door lock, said door lock enabling the locking of the door lock from inside in such a way that the lock cannot be opened with a key or a picklock, the lock including a lock body, a lock bolt inside the lock body, a lock bolt shifter inside the lock body, a lock bolt shifting lever protruding from the lock bolt shifter, a slot in the lock body for receiving the lock bolt shifting lever which is turnable between its inclined end positions in the slot when the lock bolt shifter is rotated, a twist knob inside the door for rotating the lock bolt shifter, a key cylinder outside the door, and an opening spindle present between the twist knob and the key cylinder, the opening spindle being in engagement with the lock bolt shifter for shifting the lock bolt by tuning the key or the twist knob.

WO 2014202832 shows an accessory for the security locking of a lock, said accessory enabling the locking of a lock from inside in such a way that the lock cannot be opened with a key or a picklock, the lock including a lock body, a twist knob, a key cylinder, and a shaped spindle present between the twist knob and the lock body and in engagement with a lock mechanism.

This prior known lock accessory resolves the same problem as the present invention namely precludes the possibility of unauthorized opening of the lock with illegitimate copy keys or master keys or a picklock. This prior known lock accessory has, however, the shortcoming that with some types of locks the shaped spindle (opening spindle in the present application) may be too easy to be twisted by applying excessive force by the key or picklock, thereby enabling bypassing the security locking.

It is an objective of the invention to provide a security door lock, whereby the above problem can be solved and which enables the security locking of an exterior door lock from inside in such a way that the lock cannot be opened with a key or a picklock.

This objective is attained in the invention on the basis of characterizing features as presented in claim 1. Preferred embodiments of the invention are presented in the dependent claims.

Figures 1, 1A:
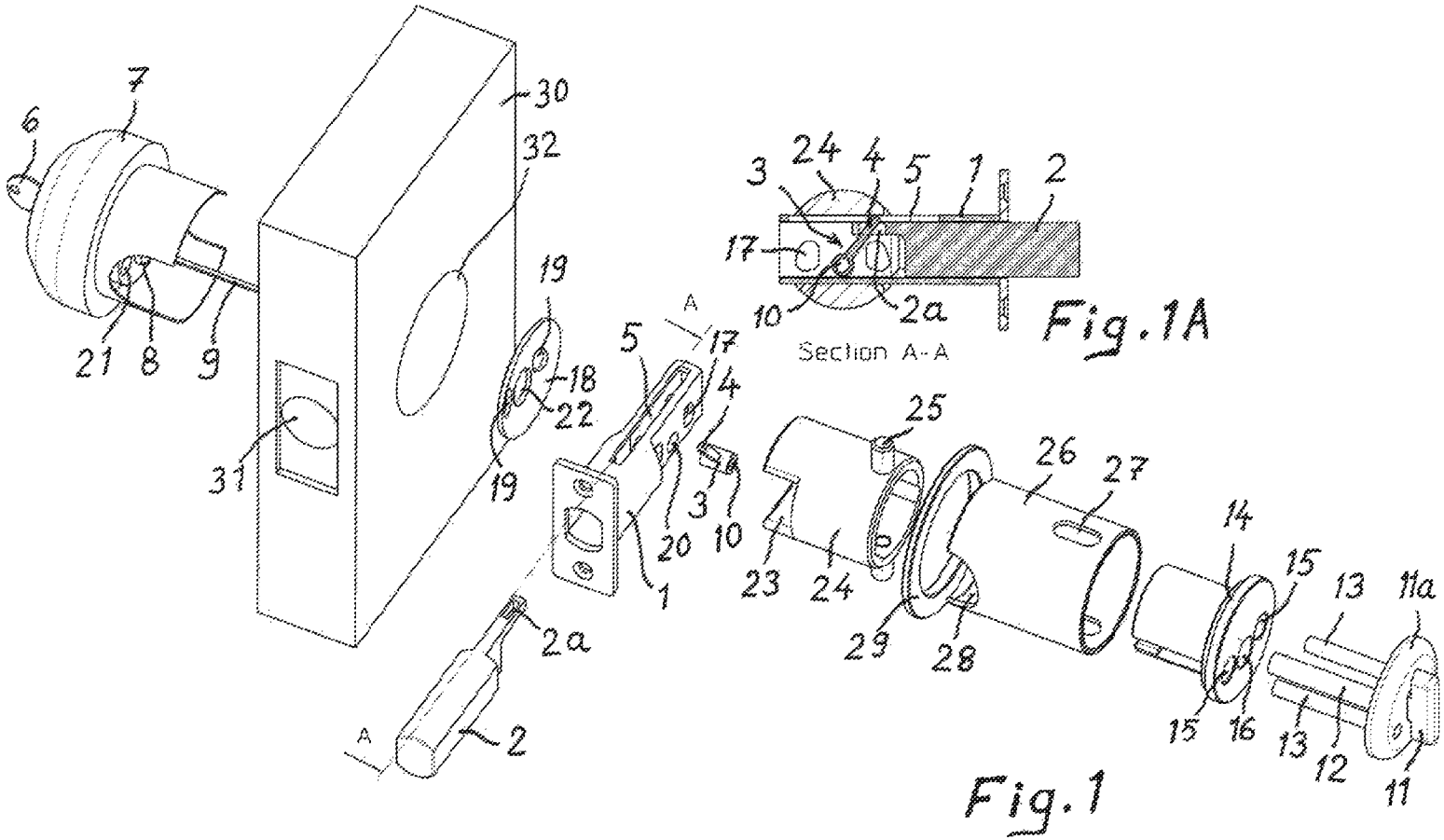
Figure 4:
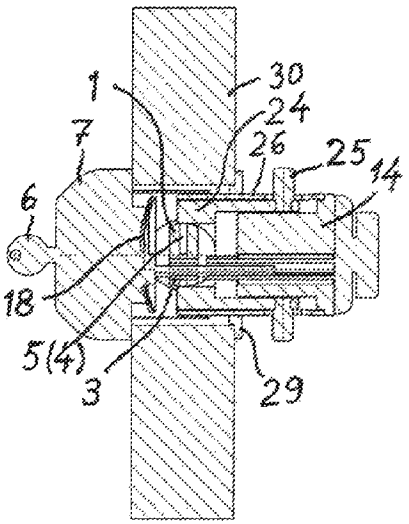
Figure 3:
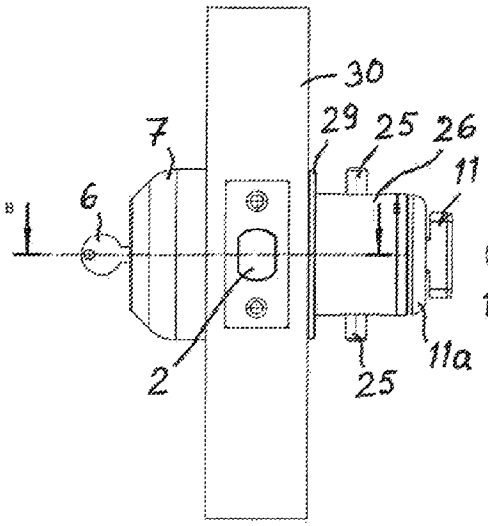
Figure 2:
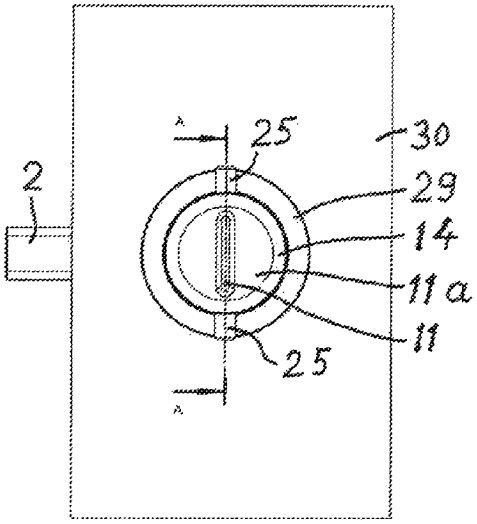
Figure 5:
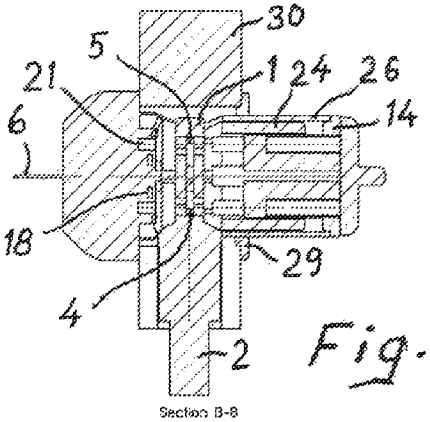

One exemplary embodiment of the invention will now be described more closely with reference to the accompanying drawings, in which FIG. 1 shows a security door lock of the invention in an exploded view, FIG. 1A shows a detail of the security door lock in a sectional view along line A-A of FIG. 1, FIG. 2 shows the security door lock of the invention in a view perpendicular to the direction of the door plane from inside the door, FIG. 3 shows the security door lock of the invention in a view along the plane of a door, FIG. 4 shows the security door lock in sectional view along line A-A of FIG. 2, FIG. 5 shows the security door lock in sectional view along line B-B of FIG. 3.

In the drawings some conventional parts (such as the lock cylinder body 7) have been shown in one block without details. A lock body 1, embedded in a bore 31 of a door 30, houses a lock bolt 2 which can be shifted into and partially out of the lock body 1 by the turning movements of a key 6 and a twist knob 11. Lock cylinder body 7 houses a lock cylinder 8 having at its end an opening spindle 9 which can be rotated by turning the key 6 and the twist knob 11 for shifting the lock bolt 2. The twist knob 11 and a key cylinder 8 are on opposite sides of the door 30 and the lock body 1. The opening spindle 9 extends between the key cylinder 8 and the twist knob 11 and extends into the interior of the twist knob's extension 12. The opening spindle 9 passes through a lock bolt shifter 3 having a shaped opening 10 which matches with the shape of the spindle 9 thereby enabling rotating the lock bolt shifter 3 by rotating the opening spindle 9.

The lock bolt shifter 3 has a protruding shifting lever 4 which is received in a slot 5 of the lock body 1. When the bolt shifter 3 is rotated by rotating the opening spindle 9, the bolt shifting lever 4 can be turned forth and back, thereby moving the lock bolt 2 between locking and un-locking positions. The above disclosed structure and function are well known with a very common lock type. The shifting lever 4 must be dimensioned long enough for engagement with the lock bolt's engagement loop 2*a* also at its inclined end positions. As a result of this, the end of the shifting lever 4 rises substantially outside the lock body 1 at its middle position. The invention utilizes this feature of the shifting lever 4 for security locking. There is provided a security latch 24 which is movable from a security locking release position to a security locking position in which the bolt shifter 3 is locked in a non-rotatable manner (FIG. 1A). In the security locking position the security latch 24 covers the slot 5 thereby preventing turning of the shifting lever from its end position. Since the bolt shifter 3 and lever 4 are made of steel, the bolt shifter 3 cannot be rotated by mediation of the opening spindle 9 by using force for turning the lock cylinder.

The security latch 24 is in the form of a cylinder and it has at its end a slot 23 whose width matches essentially with a thickness of the lock body 1, such that the slot 23 receives the lock body 1 with a sliding fit in the security locking position of the safety latch 24. In that position the safety latch covers the slot 5 and prevents rotation of the bolt shifter 3. As the safety latch 24 is pulled to the right in FIGS. 1, 3 and 4 by using finger pins 25, the space above slot 5 becomes free and the bolt shifter 3 is capable of rotation between its end positions. Accordingly, an outwards pulled position of the safety latch 24 is the security locking release position (outwards from the door and the lock body). Security latch 24 has a shape of cylinder and it is housed in a cylinder shaped sleeve 26 having elongated openings 27 for finger pins 25. The length of the elongated openings 27 determines the length of movement of the security latch 24. Sleeve 26 holds and controls position of the security latch 24. Sleeve 26 and skirt of the lock cylinder body 7 are received in bore 32 of the door whereby the lock body 1 remains between the sleeve 26 and the lock cylinder body 7. Sleeve 26 has an end slot 28 which receives the lock body 1. Steel plate 18 is inserted between the lock cylinder 8 and the lock body 1 to prevent reaching the security latch 24 from outside by tools such as bore. Steel plate 18 has been provided with holes 19 for fastening screws and with a hole 22 for opening spindle 9.

An end plug 14 is placed at the end and partly inserted within the security latch 24. End plug 14 covers also the end of sleeve 26. End plug 14 has been provided with holes 15 for fastening screws and a hole 16 for the twist knob's extension 12.

The assembly of security latch 24, its guiding sleeve 26 and the end plug 14 can be secured in place with long fastening screws which penetrate a ferrule 11*a* of the twist knob. The fastening screws extend through guiding pipes 13 into engagement with threaded holes 21 of the key cylinder body 7. Thus, the fastening screws must be made longer than the ordinary ones. Lock body 1 has holes 17 and steel plate 18 has holes 19 for the fastening screws. Holes 20 and 22 of lock body 1 and steel plate 18 are provided for passing through the opening spindle 9 into engagement with the twist knob's extension 12. Metal ring or ferrule 29 surrounds the sleeve 26 on the surface of the door 30 and is partly inserted into the bore 32.

If the security lock is provided with a battery or a power supply, the safety latch maneuvering can be obtained with electrical drive such as a servo, a solenoid, or a motor. In this case, the safety latch maneuvering can be controlled wirelessly with a remote controller.

The safety door lock according to the invention can be applied particularly to locks used in exterior doors or patio doors. Hence, the possibility of mechanically manipulating the safety latch from outside the door must be completely precluded. In other words, the mechanical operating elements of the safety latch can only be mechanically manipulated from inside the door. From outside the door, however, it is possible to allow the manipulation of an electrically operated safety latch controlled with a security code.

The invention claimed is:

1. A security door lock for security back locking of a door lock, said door lock enabling the locking of the door lock from inside in such a way that the lock cannot be opened with a key or a picklock, the lock including a lock body, a lock bolt inside the lock body, a lock bolt shifter inside the lock body, a lock bolt shifting lever protruding from the lock bolt shifter, a slot in the lock body for receiving the lock bolt shifting lever which is turnable between the lever's inclined end positions in the slot when the lock bolt shifter is rotated, a twist knob indoors for rotating the lock bolt shifter, a key cylinder outside the door, and an opening spindle present between the twist knob and the key cylinder, the opening spindle being in engagement with the lock bolt shifter for shifting the lock bolt by tuning the key or the twist knob, wherein a security latch is movable from a security locking release position to a security locking position in which the security latch covers the slot in the lock body thereby preventing turning of the lock bolt shifting lever between the lever's inclined end positions and locking the lock bolt shifter in a non-rotatable manner against turning effected with the key or the twist knob.

2. A security door lock according to claim 1, wherein there is a steel plate between the lock cylinder and the lock body.

3. A security door lock according to claim 1, wherein the security latch is in the form of a cylinder and is axially slideably inserted within a cylinder shaped sleeve.

4. A security door lock according to claim 3, wherein the security latch is provided with protruding finger pins which are located in elongated openings of the sleeve.

5. A security door lock according to claim 3, wherein the lock body is located in a bore of the door and at the end of the security latch is provided a slot which receives the lock body in the security locking position in which the security latch covers the slot in the lock body.

6. A security door lock according to claim 5, wherein at the end of the sleeve is provided a slot which receives the lock body.

7. A security door lock according to claim 2, wherein the security latch is in the form of a cylinder and is axially slide ably inserted within a cylinder shaped sleeve.

* * * * *